US006792706B2

(12) United States Patent
Nagata

(10) Patent No.: US 6,792,706 B2
(45) Date of Patent: Sep. 21, 2004

(54) NAMEPLATE MOUNTING STRUCTURE OF CAMERA

(75) Inventor: Kazuaki Nagata, Saitama (JP)

(73) Assignee: Fuji Photo Optical Co., Ltd., Saitama (JP)

( * ) Notice: Subject to any disclaimer, the term of this patent is extended or adjusted under 35 U.S.C. 154(b) by 0 days.

(21) Appl. No.: 09/949,635

(22) Filed: Sep. 12, 2001

(65) Prior Publication Data

US 2002/0029500 A1 Mar. 14, 2002

(30) Foreign Application Priority Data

Sep. 12, 2000 (JP) ..... 2000-276535

(51) Int. Cl.[7] ..... G09F 3/00
(52) U.S. Cl. ..... 40/299.01; 40/616; 396/535
(58) Field of Search ..... 40/299.01, 1.5, 40/315, 616, 800; 396/535; D16/200

(56) References Cited

U.S. PATENT DOCUMENTS

| | | | | | |
|---|---|---|---|---|---|
| 2,781,597 | A | * | 2/1957 | Doane | 40/616 |
| 3,093,918 | A | * | 6/1963 | Krakauer et al. | 40/540 |
| 3,822,494 | A | * | 7/1974 | Zivica | 40/800 |
| 3,958,260 | A | * | 5/1976 | Nagasaka | 396/535 |
| 4,197,726 | A | * | 4/1980 | Uyeda | 70/332 |
| 5,130,897 | A | * | 7/1992 | Kuzma | 362/24 |
| 5,400,098 | A | * | 3/1995 | Rydelek | 396/535 |
| 5,476,332 | A | * | 12/1995 | Cleveland, Jr. | 400/486 |

* cited by examiner

*Primary Examiner*—Brian K. Green
(74) *Attorney, Agent, or Firm*—Birch, Stewart, Kolasch & Birch, LLP.

(57) ABSTRACT

The nameplate mounting structure of a camera can be easily handled by integrally molding a flange around a nameplate portion of a nameplate to be mounted to the camera. Strength of the electroformed nameplate is improved by providing the flange around the nameplate portion of the electroformed nameplate. This prevents easy deforming in coating or assembly to facilitate handling.

2 Claims, 6 Drawing Sheets

NAMEPLATE MOUNTING STRUCTURE OF CAMERA

BACKGROUND OF THF INVENTION

1. Field of the Invention

The present invention relates to a nameplate mounting structure of a camera, and more particularly, to a nameplate mounting structure of a camera whose outer cover is mounted with an electroformed nameplate.

2. Description of the Related Art

Generally, a trademark is applied to an outer cover of a camera. The trademark is sometimes applied by printing or engraving, but for imparting a quality appearance to a camera, the trademark is sometimes applied by using an electroformed nameplate. The electroformed nameplate means a nameplate manufactured by what is known as electroforming, and conventionally, the electroformed nameplate formed in a plate shape has been attached to an outer surface of the outer cover to be mounted thereto.

However, since the electroformed nameplate is an extremely thin member with 0.2 to 0.4 mm thickness, there are disadvantages of low strength and easy deforming unless handled carefully. Especially, when mounting the electroformed nameplate to an arcuate surface, the electroformed nameplate is also formed in an arcuate shape, so that there is a disadvantage of easy deforming unless handled carefully in a coating process or an assembly process.

SUMMARY OF THE INVENTION

The present invention is made in view of the above circumstances and has its object to provide a nameplate mounting structure of a camera which can be handled easily.

In order to attain the above object, the present invention is directed to a nameplate mounting structure of a camera where a nameplate is mounted to an outer cover, wherein the nameplate is formed such that the a flange is integrally molded around a nameplate portion and that the name plate portion is projected form the flange, while the outer cover is formed, at a portion where the nameplate is mounted, with a fitting hole in which the nameplate portion is fitted, and the nameplate portion of the nameplate is fitted in the fitting hole from inside the outer cover to mount the nameplate to the outer cover.

Preferably, the nameplate is secured to a mounting plate to be mounted to the outer cover, the mounting plate is formed with a projection for positioning, while the flange of the nameplate is formed with a fitting portion where the projection for positioning is fitted, and the projection for positioning is fitted to the fitting portion to position the nameplate on a predetermined position of the mounting plate.

Preferably, the nameplate is secured to a mounting plate to be mounted to the outer cover, a front surface of the nameplate portion of the nameplate is formed with a mark, in an embossed manner, which is formed by a depressed back surface of the nameplate portion, while the mounting plate is formed with a projection to be fitted to a recess formed in the back surface of the nameplate portion, and the projection is fitted to the recess to position the nameplate on a predetermined position of the mounting plate.

According to the present invention, the strength of the nameplate per se can be improved by the flange mounted around the nameplate portion. This permits preventing easy deforming of the nameplate during handling to thereby facilitate handling. For the nameplate mounted to the outer cover, the nameplate portion only constitutes an appearance, and the flange does not appear outwardly and thus does not detract from the appearance.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of an outer cover of a nameplate mounting structure of a camera according to the present invention will be described in detail below with reference to the drawings.

Figure 1:
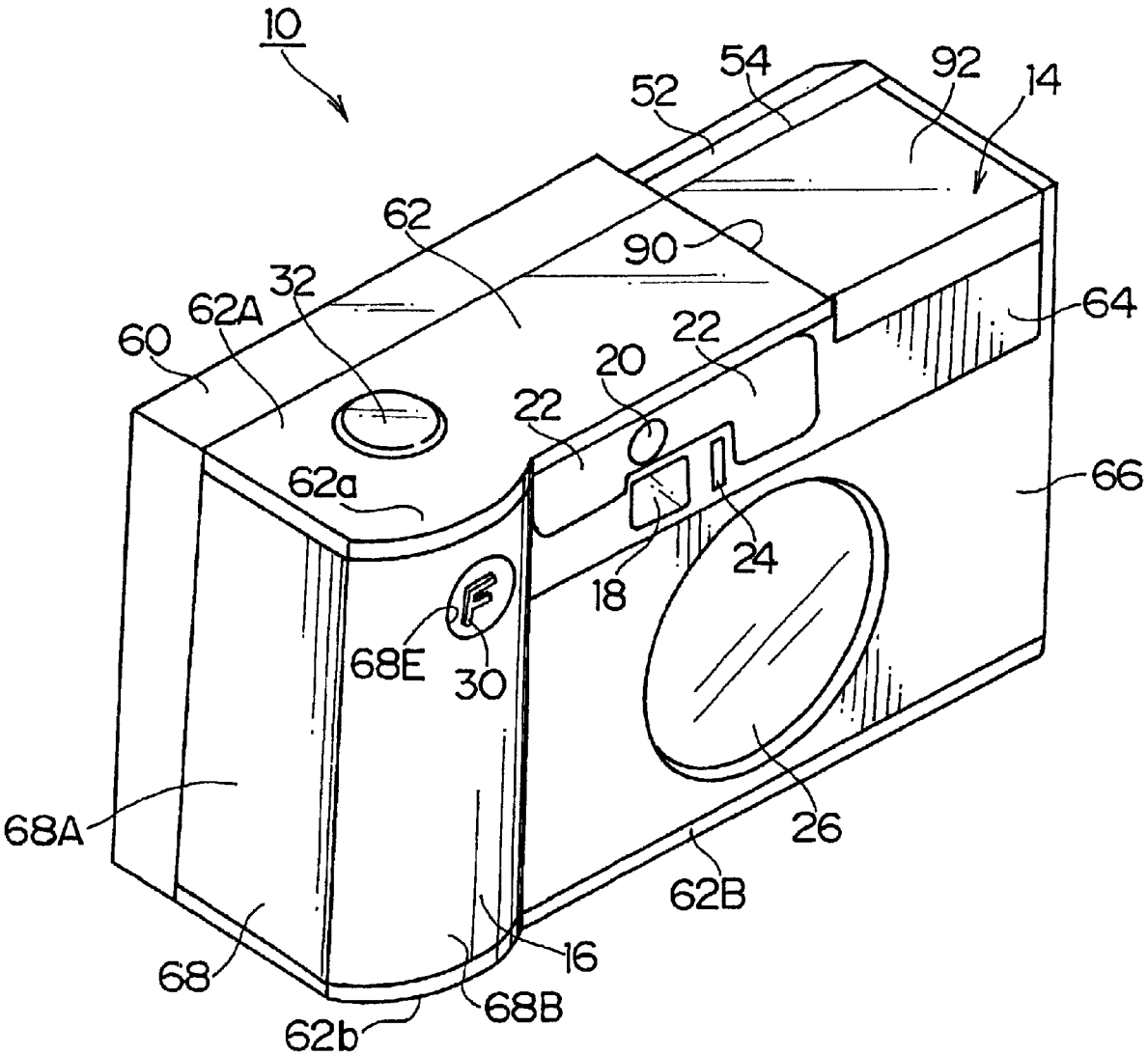
FIG. 1 is a front perspective view of an appearance of a camera according to an embodiment.
Figure 2:
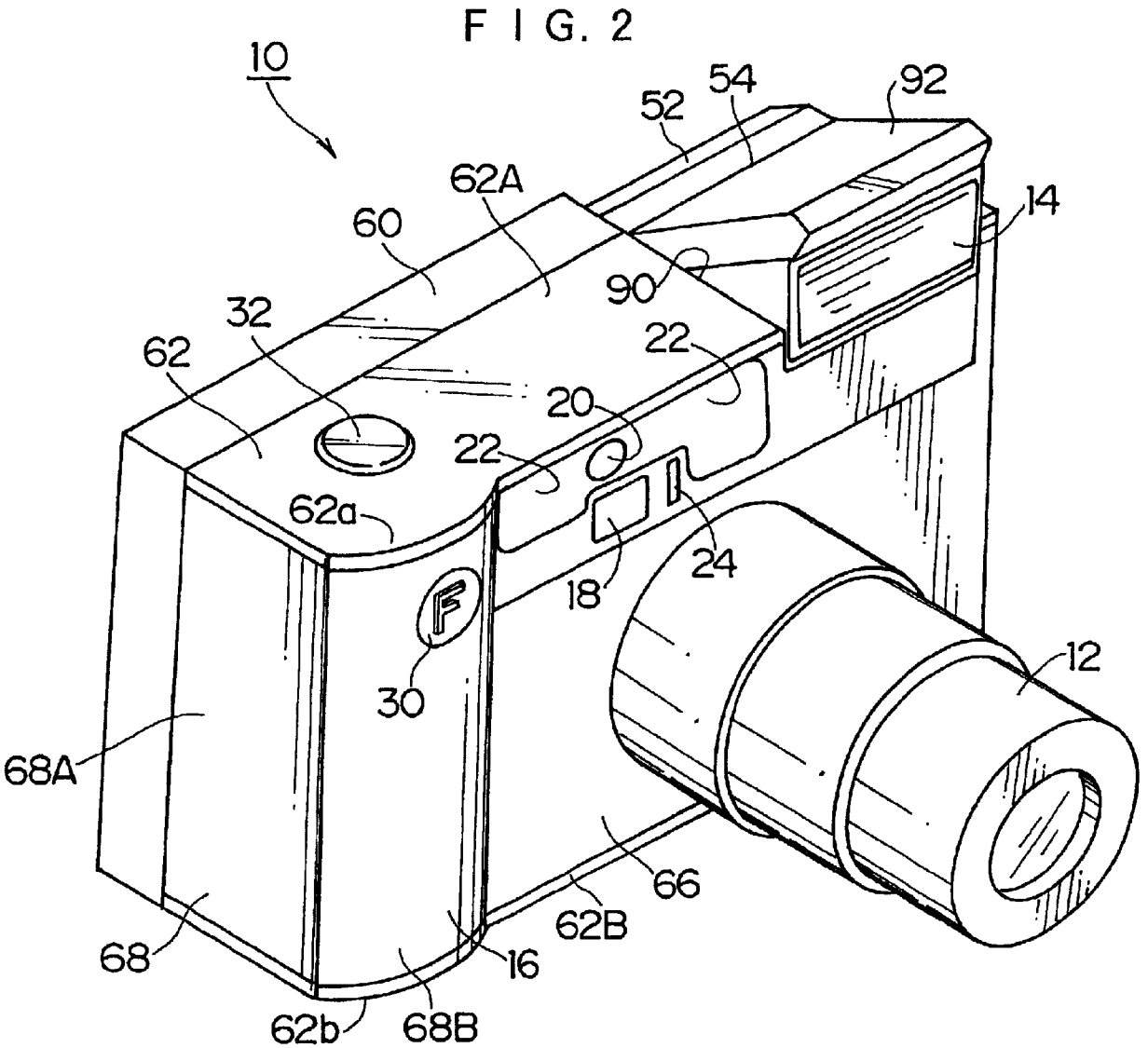
FIG. 2 is a front perspective view of the appearance of the camera according to the embodiment.

FIGS. 1 and 2, respectively are front perspective views of appearance configurations of a camera to which the present invention is applied. A camera 10 shown in the figure is an APS camera and is provided, on its front surface, with a lens barrel 12, electric flash 14, grip 16, finder window 18, AE light receiving window 20, AF windows 22, 22 and self-timer lamp 24.

The lens barrel 12 is provided substantially in the center of the front surface of the camera 10 and has a zoom function. The lens barrel 12 is of the collapsible barrel type and is extended when the camera 10 is switched on, and collapsed when the camera 10 is switched off. When the lens barrel 12 is collapsed, the front surface of the camera 10 becomes flattened, and a lens barrier 26 is shut in front of the collapsed lens barrel 12.

The electric flash 14 is provided on an upper right corner of the front surface of the camera 10. The electric flash 14 is of the pop-up type and is pivoted and raised up when the camera 10 is switched on, and accommodated in a camera body when the camera 10 is switched off.

The grip 16 is formed with a predetermined width on a left edge of the front surface of the camera 10. The grip 16 is formed with a forward arcuate bulge, and around a top end of the front surface, a circular electroformed nameplate 30 to which a trademark is applied is provided. Further, a shutter button 32 is provided on a top surface of the grip 16, and an unshown cartridge cap is provided on a bottom surface of the grip 16.

The finder window 18 is provided above the lens barrel 12, and the AE light receiving window 20 is provided above the finder window 18. The AF windows 22, 22 are provided so as to sandwich the AE light receiving window 20, and the self-timer lamp 24 is provided on the right of the finder window 18.

Figure 3:
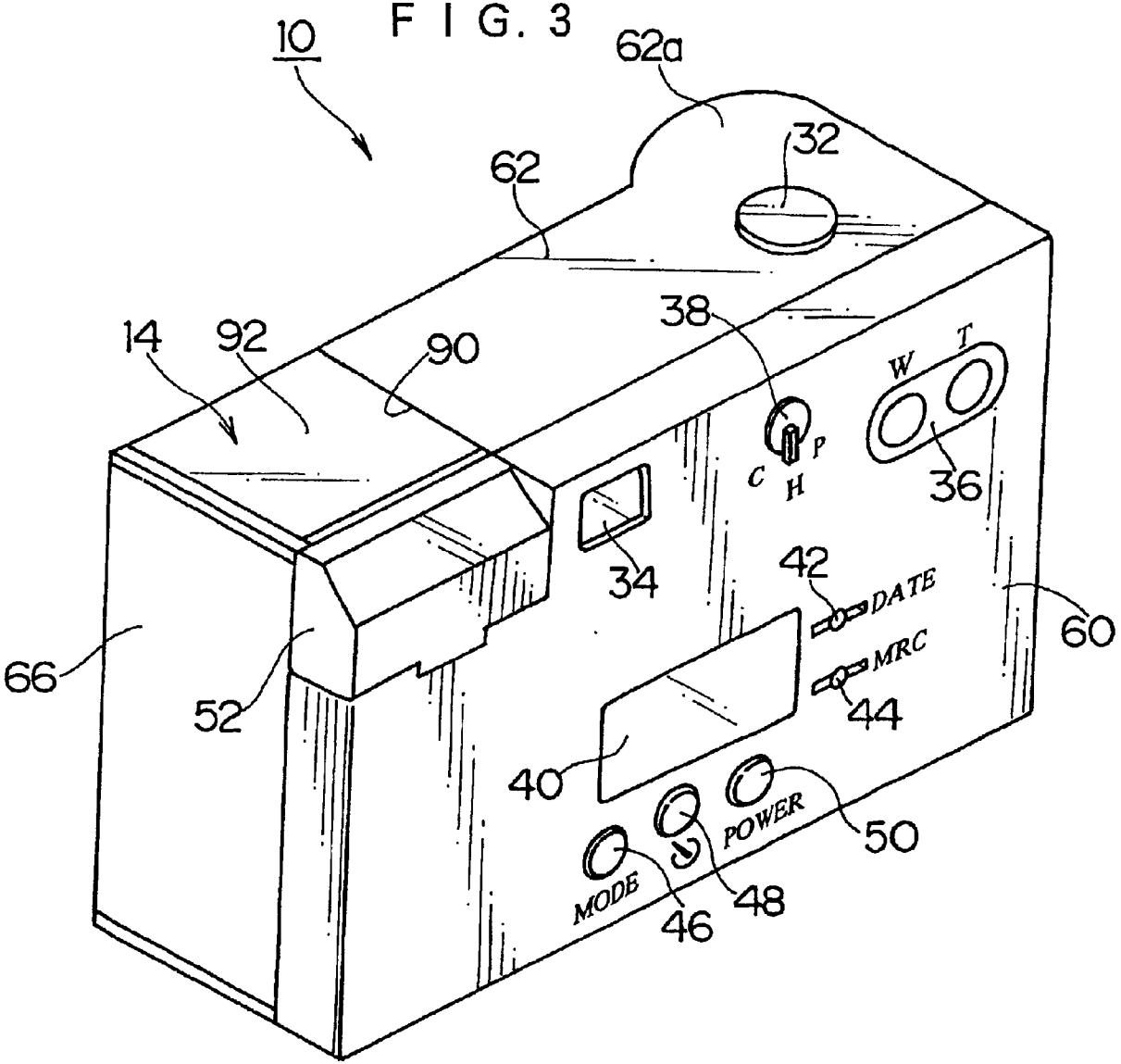
FIG. 3 is a back perspective view of the appearance of the camera according to the embodiment.

FIG. 3 is a back perspective view of the appearance configuration of the camera to which the present invention is applied. As shown in the figure, provided on a back surface of the camera 10 are a finder ocular window 34, zoom lever 36, print type switching knob 38, liquid crystal panel 40, date button 42, MRC button 44, mode button 46, self-timer button 48, power button 50 and battery cap 52.

The zoom lever 36 is provided on an upper right corner of the back surface of the camera 10, and by operating the zoom lever 36, zooming is carried out.

The print type switching knob 38 is provided on a left side of the zoom lever 36, and by operating the print type switching knob 38, print types can be switched among a conventional type (C), high vision type (H) and panorama type (P).

The liquid crystal panel 40 is formed in a rectangular shape and provided substantially in the center of the back surface of the camera 10. Displayed on the liquid crystal panel 40 are the number of exposures, taking mode, cartridge mark, self-timer mode, battery capacity, date, kinds of film, sensitivity of film, or the like.

The date button 42 is disposed on the right of the liquid crystal panel 40, and by operating the date button 42, writing of the date is selected. The MRC button 44 is similarly disposed on the right of the liquid crystal panel 40, and by operating the MRC button 44, halfway replacement of the film is selected.

The mode button 46, self-timer button 48, and power button 50 are disposed in parallel below the liquid crystal panel 40. By operating the mode button 46, the taking mode is selected, and by operating the self-timer button 48, the self-timer function is selected. By operating the power button 50, the camera 10 is switched on/off.

The battery cap 52 is disposed backward of the electric flash 14, and pivoted via a hinge to be opened/closed. At this time, the battery cap 52 is opened/closed by hooking a nail or the like onto a clearance 54 formed between the battery cap 52 and electric flash 14.

Figure 4:
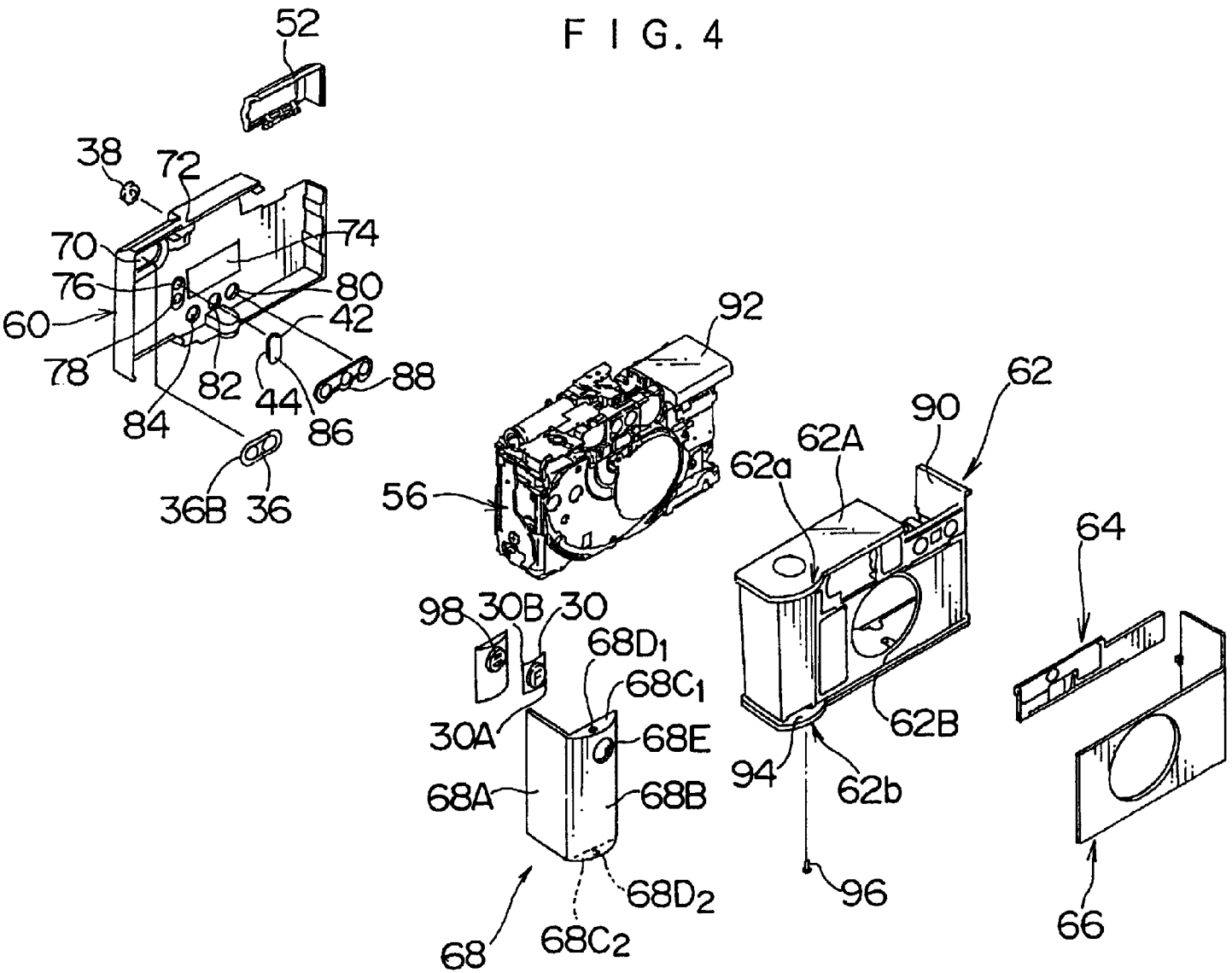
FIG. 4 is an exploded perspective view of the camera according to the embodiment.

FIG. 4 is an exploded perspective view of the camera to which the present invention is applied. As shown in the figure, the outer cover which covers a camera body 56 mainly comprises a rear cover 60, front cover 62, acrylic cover 64, metal cover 66 and grip cover 68.

The rear cover 60 is formed from plastic. Formed on a back surface of the rear cover 60 are an opening for zoom lever 70, opening for print type switching knob 72, opening for liquid crystal panel 74, opening for date button 76, opening for MRC button 78, opening for mode button 80, opening for self-timer button 82 and opening for power button 84. Various kinds of buttons disposed on the back surface of the camera 10 are fitted in respective corresponding openings to be mounted thereto. That is, the zoom lever 36 is fitted in the opening for zoom lever 70 to be mounted thereto; the print type switching knob 38, in the opening for print type switching knob 72; the liquid crystal panel 40, in the opening for liquid crystal panel 74; the date button 42, in the opening for date button 76; the MRC button 44, in the opening for MRC button 78; the mode button 46, in the opening for mode button 80; the self-timer button 48, in the opening for self-timer button 82; and the power button 50, in the opening for power button 84.

Both of the date button 42 and MRC button 44 are formed from rubber and integrally formed with a predetermined space on a base member 86. For this reason, mounting of the date button 42 and MRC button 44 to the rear cover 60 is carried out by fitting the integrated date button 42 and MRC button 44 in the opening for date button 76 and opening for MRC button 78, respectively, from inside the rear cover 60. For the integral piece of the date button 42 and MRC button 44 thus mounted, the date button 42 and MRC button 44 only project from the opening for date button 76 and opening for MRC button 78 to be exposed on an outer surface of the rear cover 60.

The mode button 46, self-timer button 48, power button 50 are similarly formed from rubber and integrally formed with a predetermined space on a base member 88. For this reason, mounting of the mode button 46, self-timer button 48 and power button 50 to the rear cover 60 is carried out by fitting the integrated mode button 46, self-timer button 48 and power button 50 in the opening for mode button 80, opening for self-timer button 82 and opening for power button 84, respectively, from inside the rear cover 60. For the integral piece of the mode button 46, self-timer button 48 and power button 50 thus mounted, the mode button 46, self-timer button 48 and power button 50 only project from the opening for mode button 80, opening for self-timer button 82 and opening for power button 84 to be explosed on the outer surface of the rear cover 60.

The zoom lever 36 is formed with a flange 36B at its outer peripheral edge, and when the zoom lever 36 is mounted to the opening for zoom lever 70 from inside the rear cover 60, the zoom lever 36 only projects from the opening for zoom lever 70 to be exposed on the outer surface of the rear cover 60.

Now, when the rear cover 60 mounted with various kinds of operation buttons or the like as described above is mounted to the camera body 56, the outer surface of the rear cover 60 as it is constitutes an appearance of the camera 10. For this reason, the outer surface of the rear cover 60 is coated with rubber and treated to be matted.

On the other hand, for the various kinds of operation buttons provided on the outer surface of the rear cover 60 which is thus matted, their respective surfaces are treated to be smooth. That is, the outer surfaces of the zoom lever 36, mode button 46, self-timer button 48 and power button 50 are treated to be smooth.

As described above, the mode button 46, self-timer button 48, power button 50 are integrally formed on the base member 88, and the integral piece is treated to be smooth at portions appearing on the outer surface of the rear cover 60 only, that is, the buttons only. Similarly, the zoom lever 36 is treated to be smooth at portions appearing on the outer surface of the rear cover 60 only, that is, the buttons only.

The integral piece of the mode button 46, self-timer button 48, power button 50 is molded by pouring rubber into a predetermined mold, and at this time, by polishing portions of the mold corresponding to the buttons, the buttons only of the molded integral piece can be treated to be smooth.

The front cover 62 is formed from plastic similarly to the rear cover 60. A top surface (top cover) 62A and bottom surface (bottom cover) 62B only of the front cover 62 constitute an appearance of the camera 10, and top and both side surfaces thereof are mounted with the acrylic cover 64, metal cover 66 and grip cover 68 to be covered with them. The top surface 62A and bottom surface 62B which constitute an appearance surface are coated with rubber and treated to be matted similarly to the rear cover 60.

An opening for electric flash 90 is formed on a right corner of the top surface 62A of the front cover 62, and an electric flash cover 92 of the electric flash 14 provided in the camera body 56 is fitted in the opening for electric flash 90. The electric flash cover 92 is formed from plastic, and its outer surface is coated with rubber and treated to be matted similarly to the front cover 62.

The metal cover 66 is formed by machining an aluminum plate to be of L shape, and its surface is anodized. The metal cover 66 is mounted so as to surround the front and right side surfaces of the front cover 62.

For the front cover 62 to which the metal cover 66 is mounted, the top surface 62A and bottom surface 62B are formed so as to project the length corresponding to the thickness of the metal cover 66. The metal cover 66 is mounted so as to be fitted between the top surface 62A and bottom surface 62B of the front cover 62 thus formed in a projecting manner.

The metal cover 66 is secured to the front cover 62 by a double-faced adhesive tape or an adhesive.

The grip cover 68 is similarly formed by machining an aluminum plate, and its surface is anodized. The grip cover 68 is, as shown in FIG. 4, constituted by a side portion 68A and grip portion 68B and mounted so as to surround a left side portion and front grip portion of the front cover 62.

The side portion 68A is formed in the shape of a rectangular plate, and the left side of the front cover 62 is covered with the side portion 68A.

On the other hand, the grip portion 68B is formed in an arcuate shape, and at the top and bottom thereof, crescent reinforcing portions $68C_1$, $68C_2$ are respectively formed. The reinforcing portions $68C_1$, $68C_2$ are integrally molded with the top and bottom, respectively of the grip portion 68B by drawing. A positioning hole $68D_1$ is formed in the upper reinforcing portion $68C_1$, and a screw hole $68D_2$ is formed in the lower reinforcing portion $68C_2$.

The front cover 62 to which the grip cover 68 is mounted is formed, at its top surface 62A, with a protruding portion 62*a* in an arcuate shape, and an unshown positioning pin is formed in a projecting manner on a lower surface of the protruding portion 62*a*. When the grip cover 68 is mounted to the front cover 62, the positioning pin is fitted in the positioning hole $68D_1$ formed in the upper reinforcing portion $68C_1$. This allows the grip cover 68 to be correctly mounted to a normal position.

The front cover 62 is also formed, at its bottom surface 62B, with a similar arcuate protruding portion 62*b*, and a screw hole 94 is formed in the protruding portion 62*b*. When the grip cover 68 is mounted to the front cover 62 as described above, the screw hole $68D_2$ formed in the lower reinforcing portion $68C_2$ is positioned coaxially with the screw hole 94 formed in the protruding portion 62*b*. The screw 96 is screwed in the screw holes $68D_2$, 94 from the bottom surface side of the front cover 62, which secures the grip cover 68 to the front cover 62.

The grip portion 68B of the grip cover 68 is formed with a circular electroformed nameplate mounting hole 68E, and the electroformed nameplate 30 is mounted to the electroformed nameplate mounting bole 68E via an electroformed nameplate mounting plate 98.

Figure 5:
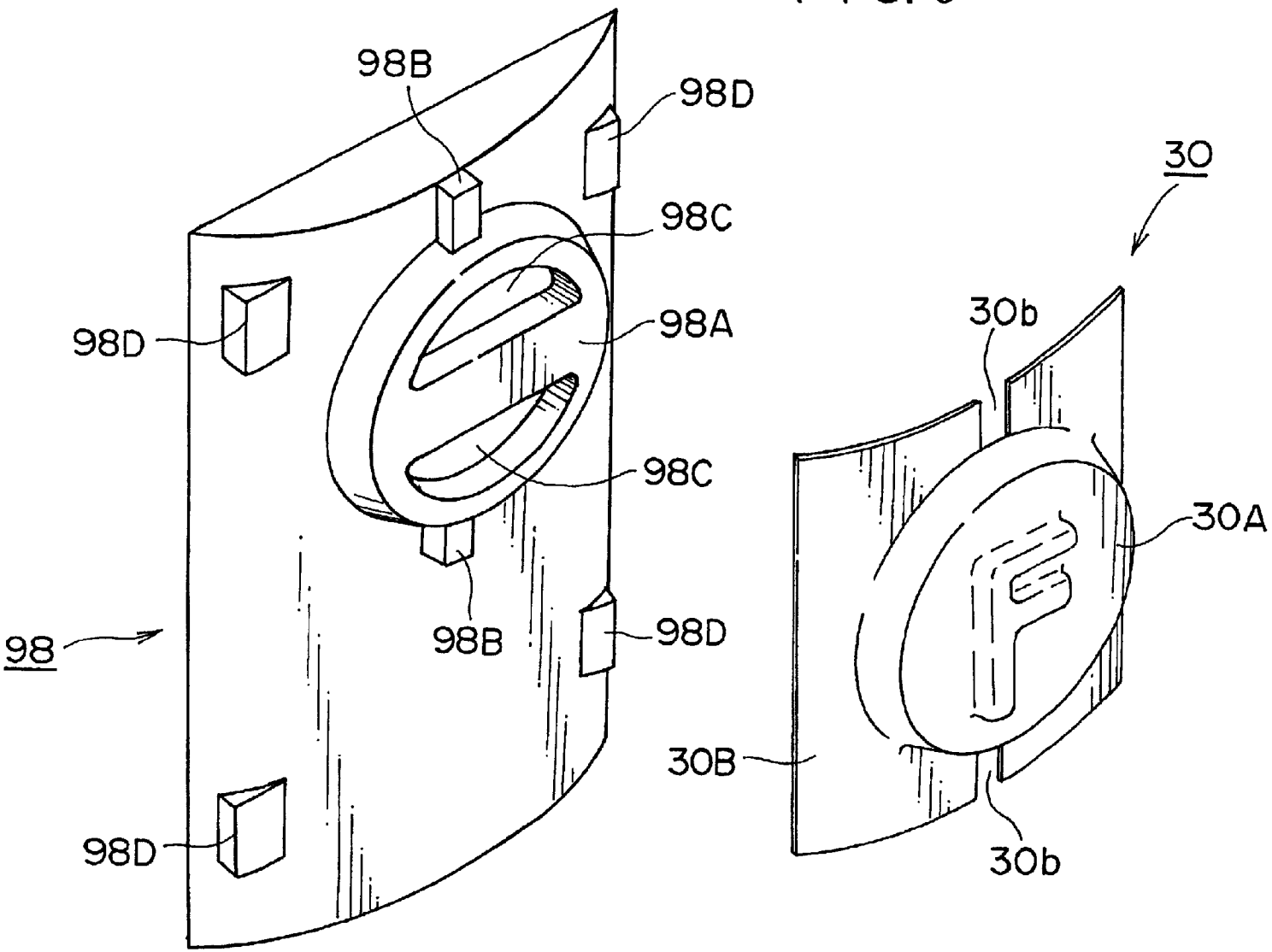
FIG. 5 is a perspective view of a configuration of an electroformed nameplate.

A surface of the electroformed nameplate mounting plate 98 for mounting the electroformed nameplate 30 is, as shown in FIG. 5, formed in an arcuate shape along the shape of the grip portion 68B and has a nameplate mounting portion 98A in a disk shape around the top.

The electroformed nameplate 30 is also formed, as a whole, so as to be curved in an arcuate shape along the shape of the grip portion 68B. The electroformed nameplate 30 comprises a nameplate portion 30A in a disk shape and a flange 30B, and is mounted to the electroformed nameplate mounting plate 98 by fitting the nameplate portion 30A to the nameplate mounting portion 98A of the electroformed nameplate mounting plate 98. That is, the nameplate portion 30A of the electroformed nameplate 30 is formed in a projecting manner from the flange 30B, and its back surface is hollow along the projecting shape of the front surface. Therefore, by fitting the hollow portion of the back surface to the nameplate mounting portion 98A of the electroformed nameplate mounting plate 98, the electroformed nameplate 30 is mounted to the electroformed nameplate mounting plate 98.

The flange 30B of the electroformed nameplate 30 is formed with notches for positioning 30*b*, 30*b* at its top and bottom positions, and the notches for positioning 30*b*, 30*b* are fitted to positioning projections 98B, 98B formed on the surface of the electroformed nameplate mounting plate 98. This allows the electroformed nameplate 30 to be mounted to a normal position of the electroformed nameplate mounting plate 98.

The mounting portion 98A of the electroformed nameplate mounting plate 98 is formed with a pair of through holes 98C, 98C. The electroformed nameplate 30 mounted to the electroformed nameplate mounting plate 98 is secured to the surface of the electroformed nameplate mounting plate 98 by pouring the adhesive from the back side into the through holes 98C, 98C.

Then, the electroformed nameplate 30 mounted to the electroformed nameplate mounting plate 98 as described above is, as shown in FIG. 4, mounted to the grip portion 68B by fitting the nameplate portion 30A in the nameplate mounting hole 68E formed in the grip portion 68B. At this time, the electroformed nameplate mounting plate 98 is secured to the inner surface of the grip portion 68B by applying the adhesive to legs 98D, 98D, . . . formed on the four corners of the surface.

The electroformed nameplate 30 is thereby mounted to the grip cover 68. Then, for the electroformed nameplate 30 thus mounted, the nameplate portion 30A only to which a trademark is applied on its surface appears outwardly of the grip cover 68.

The acrylic cover 64 is formed from acrylic and mounted so as to cover the upper portion of the front surface of the front cover 62. The acrylic cover 64 is translucently formed as a whole, and portions covering the finder window 18 and electric flash 14 are transparently formed.

As described above, the front cover 62 is mounted with the acrylic cover 64, metal cover 66 and grip cover 68, and this integral piece is mounted to the front surface of the camera body 56. Then, the front cover 62 mounted to the camera body 56 is made integral with the rear cover 60 mounted to the back surface of the camera body 56 to constitute the outer cover of the camera 10.

The camera 10 to which the present invention is applied is configured as described above. In this camera 10, the electroformed nameplate 30 mounted to the grip cover 68 is reinforced by the flange 30B mounted around the nameplate portion 30A, which facilitates handling in coating or assembly of the electroformed nameplate 30.

That is, the electroformed nameplate 30 may be used as it is in a manufactured state by electroforming, but generally mounted to the camera 10 in a coated state.

At this time, having a constant strength as the electroformed nameplate 30 of this embodiment permits easily carrying out coating work. Especially in the case where the electroformed nameplate 30 is formed in the arcuately curved manner as this embodiment, the strength is remarkably improved compared to an electroformed nameplate in a simply curved plate shape and handling is also facilitated.

The coating is carried out, for example, by coating ink across the front surface of the projected nameplate portion 30A with a brush and wiping the trademark portion of the embossed mark (e.g., a trade mark, a letter, and a letter "F" portion here) with a cloth or the like. Even when the coating is carried out via such a plurality of processes, the coating work can be easily carried out since there is no need for taking care in deforming or the like.

The electroformed nameplate 30 is required to be mounted straight to a normal position due to its nature, and the electroformed nameplate 30 of this embodiment can be easily mounted to the normal position by using the notch for positioning 30*b* formed at the flange 30B. The notch for positioning 30*b* does not appear outwardly and thus does not detract from the appearance of the camera 10.

Positioning of the electroformed nameplate 30 can be also carried out by the following method. That is, the trademark applied to the front surface of the nameplate 30A of the electroformed nameplate 30 (the letter "F" here) is formed in an embossed manner on the front surface of the nameplate portion 30A, and its back side is formed with a recess corresponding to the shape of the trademark. Thus, the positioning is carried out using the recess groove.

Figure 6:
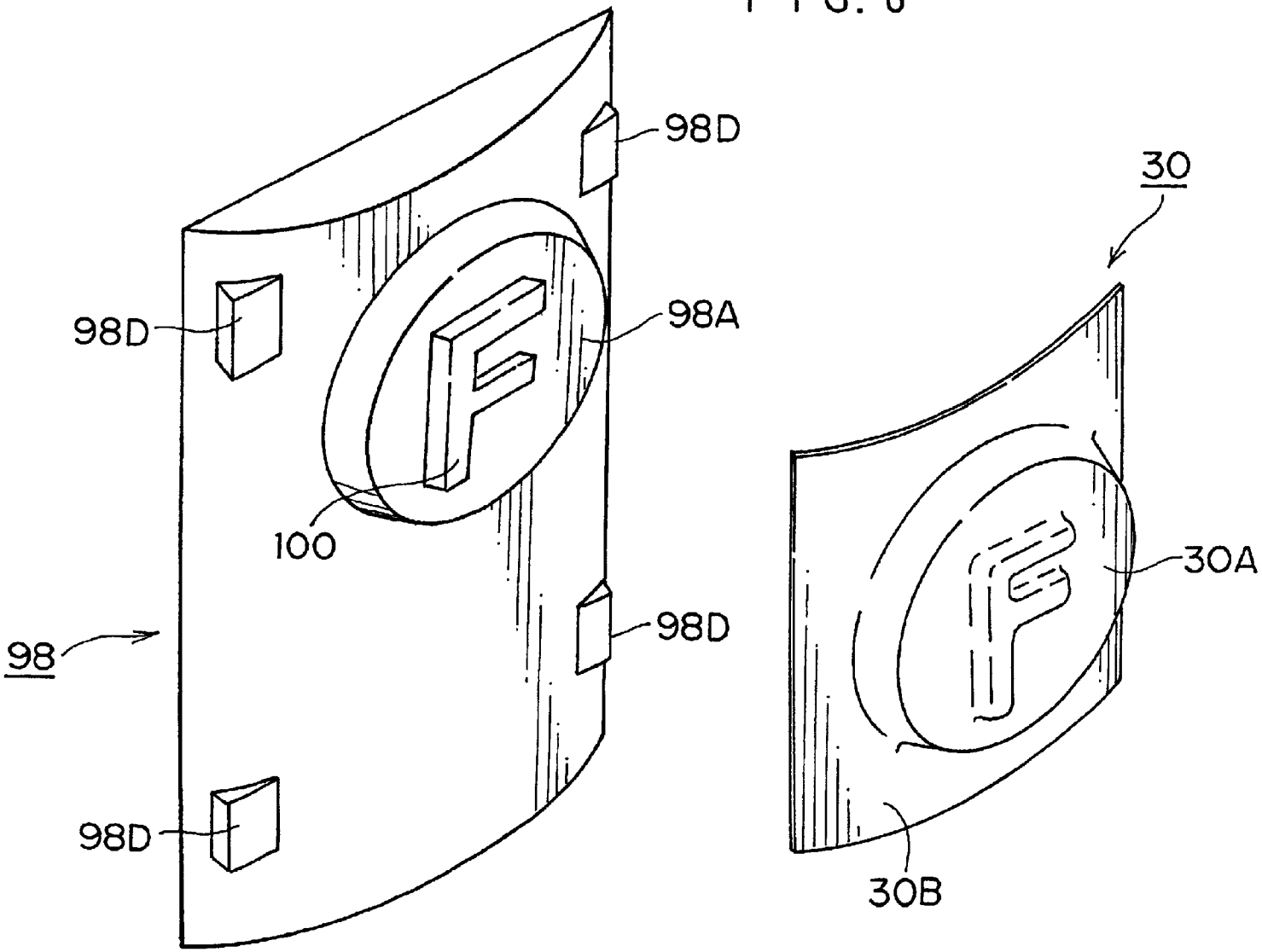
FIG. 6 is a perspective view of a configuration of another embodiment of an electroformed nameplate.

Specifically, as shown in FIG. 6, a projection 100 to be fitted to the recess formed on the back surface of the nameplate portion 30A of the electroformed nameplate 30 is formed on the surface of the nameplate mounting portion 98A of the electroformed nameplate mounting plate 98. As shown in FIG. 6, the electroformed nameplate 30 of this embodiment has the letter "F" as the trademark applied to the front surface of the nameplate portion 30A, so that the back surface of the nameplate portion 30A is formed with a recess corresponding to the letter "F". Therefore, the projection 100 corresponding to the letter "F" is formed on the surface of the nameplate mounting portion 98A of the electroformed nameplate mounting plate 98.

When mounting the electroformed nameplate 30 to electroformed nameplate mounting plate 98, the recess formed on the back surface of the nameplate portion 30A of the electroformed nameplate 30 is fitted to the projection 100 formed on the nameplate mounting portion 98A of the electroformed nameplate forming plate 98 to be mounted thereto. In this case, the projection 100 of the nameplate mounting portion 98A is fitted to the recess of the back surface of the trademark portion 30A at only one position, so that the electroformed nameplate 30 is automatically mounted to the normal position of the electroformed nameplate mounting portion 98 when the projection 100 of the nameplate mounting portion 98A is fitted to the recess of the back surface of the trademark portion 30A.

In this way, the electroformed nameplate 30 can be also easily positioned and mounted by the above described method. Further, the electroformed nameplate 30 can be also mounted without detracting from the appearance of the camera 10 by this method.

In this embodiment, description has been made on the electroformed nameplate 30 manufactured by electroforming as an example, but the present invention can be effectively applied to a nameplate manufactured by press molding.

In this embodiment, the electroformed nameplate 30 is mounted to the electroformed nameplate mounting plate 98 to be mounted to the grip cover 68, but the electroformed nameplate 30 may be mounted to the front cover 62 to be mounted to the grip cover 68.

The electroformed nameplate 30 may be mounted to the grip cover 68 by applying the adhesive to a surface of the flange 30B and adhering the flange 30B to the inner surface of the grip cover 68.

As described above, according to the present invention, the strength of the nameplate per se can be improved by the flange mounted around the nameplate portion, which facilitates handling. Further, for the nameplate mounted to the outer cover, the nameplate portion only constitutes an appearance, and the flange does not appear outwardly and thus does not detract from the appearance.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nameplate mounting structure of a camera having a nameplate mounted to an grip cover, wherein the nameplate for the camera is formed such that a flange is integrally molded around a nameplate portion and that the nameplate portion is projected from the flange, while the grip cover is formed, at a portion where the nameplate for the camera is mounted, with a fitting hole in which the nameplate portion is fitted, and the nameplate portion of the nameplate for the camera is fitted through the fitting hole from inside the grip cover to mount the nameplate for the camera to the grip cover, wherein the nameplate is shaped to fit an arcuate shape of the grip cover, and wherein the nameplate is secured to a mounting plate to be mounted on the grip cover, a front surface of the nameplate portion of the nameplate for the camera is formed with a mark, in an embossed manner, which is formed by depressing a back surface of the nameplate portion, while the mounting plate is formed with a projection to be fitted to a recess formed in the back surface of the nameplate portion, and the projection is fitted to the recess to position the nameplate for the camera on a predetermined position of the mounting plate.

2. A nameplate mounting structure, comprising:

a nameplate including a nameplate portion integrally formed with a flange, wherein the nameplate portion projects from the flange;

a mounting plate including a mounting portion configured to receive the nameplate portion such that the nameplate is aligned and secured to the mounting plate; and an grip cover with a hole such that the nameplate and the mounting plate mounts to the grip cover such that the nameplate portion is fitted through the hole of the grip cover, wherein the nameplate, the mounting plate, and the grip cover are fixedly secured, wherein the mounting plate includes a plurality of legs configured to secure the nameplate to the mounting plate, and wherein the mounting portion of the mounting plate includes a projection corresponding to a mark embossed on the nameplate portion of the name plate, wherein the projection is used to align the nameplate.

* * * * *